US007764917B2

(12) United States Patent
Ueno

(10) Patent No.: US 7,764,917 B2
(45) Date of Patent: Jul. 27, 2010

(54) IMAGE FORMING APPARATUS INCLUDING A PHOTOSENSITIVE MEMBER, A CLEANING BLADE, AND A CLEANING BRUSH

(75) Inventor: Takashi Ueno, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 820 days.

(21) Appl. No.: 11/565,884

(22) Filed: Dec. 1, 2006

(65) Prior Publication Data

US 2007/0127949 A1 Jun. 7, 2007

(30) Foreign Application Priority Data

Dec. 6, 2005 (JP) ..... 2005-352754

(51) Int. Cl.
*G03G 15/02* (2006.01)
*G03G 21/00* (2006.01)

(52) U.S. Cl. ..... 399/350; 399/175; 399/353

(58) Field of Classification Search ..... 399/174–176, 399/350, 353

See application file for complete search history.

(56) References Cited

U.S. PATENT DOCUMENTS 5,555,079 A * 9/1996 Adachi et al. ..... 399/175
6,393,238 B1 * 5/2002 Hashimoto et al. ..... 399/175
6,470,161 B2 * 10/2002 Fujishiro et al. ..... 399/159
2005/0135852 A1 * 6/2005 Sekiguchi ..... 399/349
2006/0127147 A1 6/2006 Ueno

FOREIGN PATENT DOCUMENTS

JP 6-230650 8/1994

* cited by examiner

*Primary Examiner*—David M Gray
*Assistant Examiner*—Gregory H Curran
(74) *Attorney, Agent, or Firm*—Fitzpatrick, Cella, Harper & Scinto

(57) ABSTRACT

An image forming apparatus includes a cleaning blade for removing toner from a rotatable photosensitive member by contacting the photosensitive member at a contact position after a transfer operation of a transfer member. The cleaning blade has an end which is outside the end of a magnetic particle carrying region. A cleaning brush is disposed upstream of the contact position with respect to a rotational direction of the photosensitive member, for removing the toner from the photosensitive member by contacting the photosensitive member. The cleaning brush has an end which is outside the end of the magnetic particle carrying region.

4 Claims, 6 Drawing Sheets

IMAGE FORMING APPARATUS INCLUDING A PHOTOSENSITIVE MEMBER, A CLEANING BLADE, AND A CLEANING BRUSH

FIELD OF THE INVENTION

The present invention relates to an image forming apparatus of an electrophotographic type, an electrostatic recording type or the like, more particularly, to an image forming apparatus employing a magnetic brush contact charging system.

DESCRIPTION OF THE RELATED ART

A magnetic brush type charger (magnetic brush charger) using magnetic particles is known as a charger of a contact charging type for charging the image bearing member in an image forming apparatus of the electrophotographic type or the electrostatic recording type. The magnetic brush type device is usable for a color image forming apparatus including a developing member for developing an electrostatic latent image with toner and an intermediary transfer member for receiving a toner image from the photosensitive drum.

In the magnetic brush charger, a charged carrier in the form of electroconductive magnetic particles is magnetically confined directly on a magnet or on a charging sleeve (magnetic particle carrying member) enclosing a magnet to constitute a magnetic brush portion. The magnetic brush charger has a magnetic brush portion which is contacted to the image bearing member while rotating or not rotating, and is supplied with a predetermined charging bias voltage, by which the surface of the image bearing member is contact charged uniformly to a predetermined potential of a predetermined polarity.

The magnetic brush charger is advantageous since the charging can be effected through the injection charging type system, and since the ambient condition dependence is low, and in addition, since the applied voltage to the contact charging member may be equivalent to the image bearing member potential because no electrical discharge is used. Furthermore, it is advantageous in that no ozone is produced, so that it effects a completely ozoneless, low electric power and economical charging operation.

However, there is a problem of end deposition of the charged carrier with the magnetic brush charger.

In the end portion on the charging sleeve of the magnetic brush charger, there are a coated region which is coated with the charged carrier and a non-coated region which is not coated therewith. In the magnetic brush charger, an amount of the coated magnetic particles reduces at the boundary portion between the coated region and the non-coated region. Therefore, the potential of the photosensitive drum becomes low in such as region so that potential difference between the magnetic brush portion and the photosensitive drum becomes higher than the central portion in such a region. As a result, the charged carrier is deposited onto the surface of the image bearing member from the magnetic brush charger at the end by the potential difference.

This may cause a problem whether the image is transferred onto an intermediary transfer member and then transferred onto a transfer material or the image is transferred directly onto the transfer member.

The carrier deposited on the end of the charging member is collected by the developing member, and by this, there occurs a toner content variation due to the variation of the carrier/toner ratio. When it is deposited on the image bearing member and/or the intermediary transfer member, the image bearing member and/or the intermediary transfer member (transfer member) may be damaged by being pressed by electroconductive members.

Japanese Laid-open Patent Application Hei 06-230650 discloses a structure wherein the position of the developing member and/or the end position of the transfer member is made inside the end position of the charging member so that carrier particles are not collected by the developing member and/or the intermediary transfer member. In addition, in order to collect the carrier deposited at the end, there is provided a magnetic particle collection member for collecting the carrier at the end outside the end position of the charging member.

However, the structure of Japanese Laid-open Patent Application Hei 06-230650 is intended to dam the magnetic particles by a magnet, and therefore, when the amount of the end carrier particles increases, the carrier particles may circumvent the end position. Therefore, the carrier concentrates at one position of the cleaning blade. In order to prevent this, there may be provided rotatable auxiliary cleaning means which can prevent the localized concentration.

However, although the rotation can prevent the carrier concentration, the rotation may scatter the carrier particles. This may result in incapability of complete carrier collection, and then, the particles continue remaining on the photosensitive drum.

SUMMARY OF THE INVENTION

Accordingly, it is a principal object of the present invention to provide an electrophotographic image forming apparatus, wherein the influence of deposition of the carrier on the image bearing member to another member or members is suppressed.

It is another object of the present invention to provide an electrophotographic image forming apparatus, wherein the carrier concentration on a part of a cleaning member while the magnetic particle is collected, is suppressed.

According to an aspect of the present invention, there is provided an image forming apparatus comprising a rotatable image bearing member: charging means, including magnetic particles contacted to said image bearing member and a magnetic particle carrying member for carrying said magnetic particles, for charging a surface of said image bearing member; developing means for developing an electrostatic latent image on said image bearing member, said developing means including a toner carrying member for carrying toner, and the toner carrying member having an end which is disposed inside an end a magnetic particle carrying region of said charging means; a transfer member for transferring a toner image from said image bearing member onto a toner image receiving member, said transfer member having an end which is inside the end of the magnetic particle carrying region; a cleaning member for removing the toner from said image bearing member after transfer operation of said transfer member, said cleaning member having an end which is outside the end of the magnetic particle carrying region; and an auxiliary cleaning member, disposed upstream of said cleaning member with respect to a rotational direction of said image bearing member, for removing subsidiarily the toner from said image bearing member by contacting said image bearing member, said auxiliary cleaning member having an end which is outside the end of the magnetic particle carrying region.

While the invention has been described with reference to the structures disclosed herein, it is not confined to the details set forth, and this application is intended to cover such modification or changes as may come within the purposes of the improvements or the scope of the following claims.

DETAILED DESCRIPTION OF THE PREFERRED EMBODIMENTS

Figure 1:
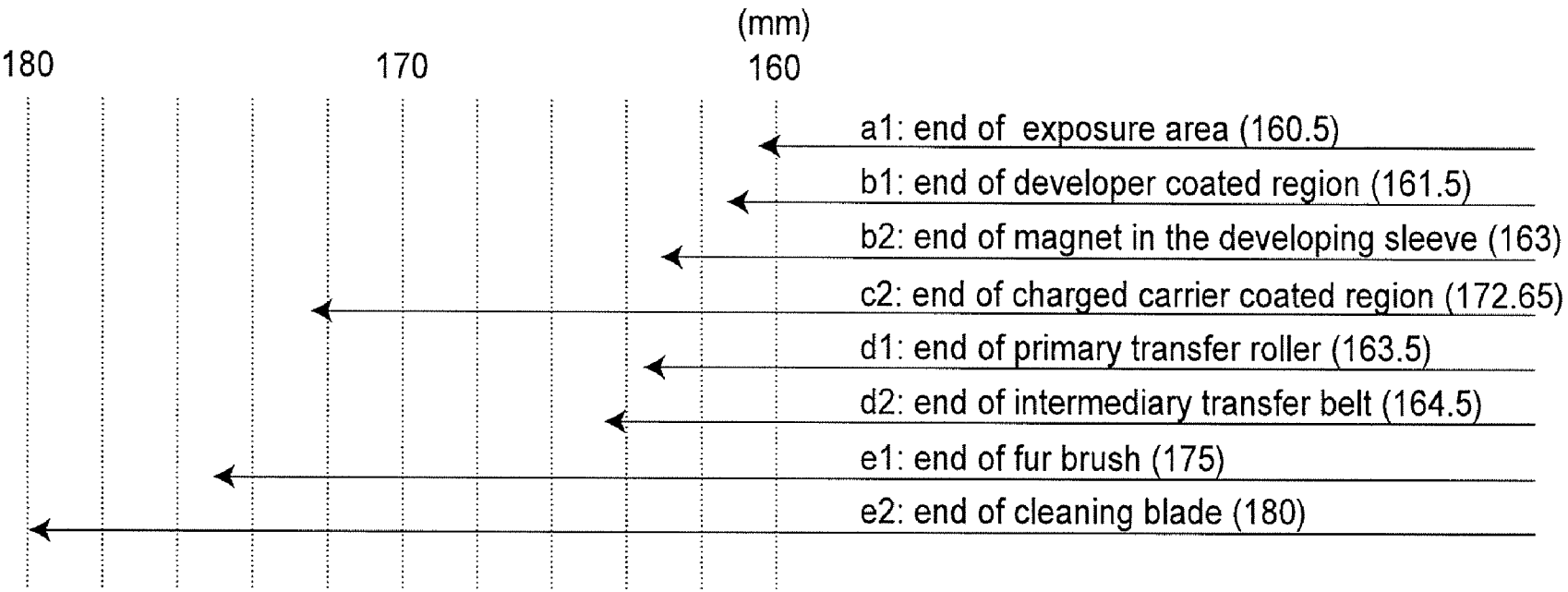
FIG. 1 is a diagram illustrating end positions of various parts of an electrophotographic image forming apparatus according to an embodiment of the present invention.

The preferred embodiment of the present invention will be described. The same reference numerals are assigned to the elements having the corresponding functions in the embodiments, and the repeated detailed description thereof are omitted for simplicity.

Embodiment 1

Figure 2:
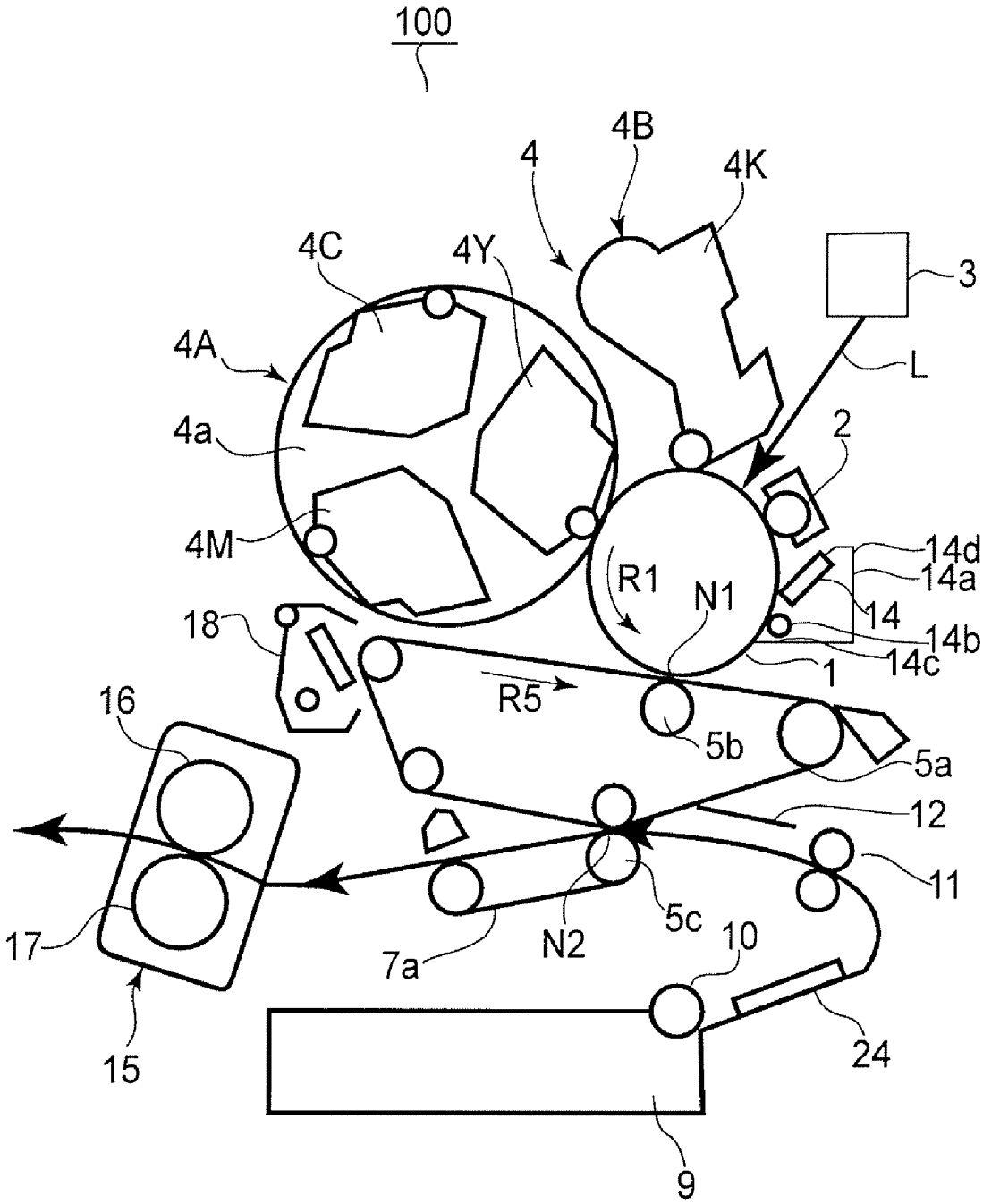
FIG. 2 schematically illustrates a structure of the image forming apparatus according to the embodiment of the present invention.

FIG. 2 shows an image forming apparatus to which the present invention is applicable. The image forming apparatus is an image forming apparatus of an electrophotographic photograph type and is provided with charging means in the form of a magnetic brush charger. The Figure is a longitudinal sectional view schematically illustrating the structure thereof.

The image forming apparatus is provided with an image bearing member in the form of a drum type electrophotographic photosensitive member (photosensitive drum). Adjacent to the surface of the photosensitive drum 1, there is provided a magnetic brush charger (charging means) 2. In addition, around the photosensitive drum 1, there are provided an exposure device (image information writing means) 3, a developing device (developing means) 4, a transferring device (transferring means) 5 which may include a primary transfer member, an intermediary transfer member and a secondary transfer member. A fixing device (fixing means) 17 is provided downstream of the transferring device 5*c* with respect to the feeding direction (arrow) of the recording material 24 (recording material).

The photosensitive drum 1 may be an ordinary organic photosensitive member (OPC photosensitive member) or the like. Desirably, a surface layer having a resistivity of $10^9$-$10^{14}$ Ωcm is provided on the organic photosensitive member, or an amorphous silicon photosensitive member is used, since then the injection charging with which ozone production is prevented with the reduced electric energy consumption can be effected. In addition, the charging property can be improved.

Figure 3:
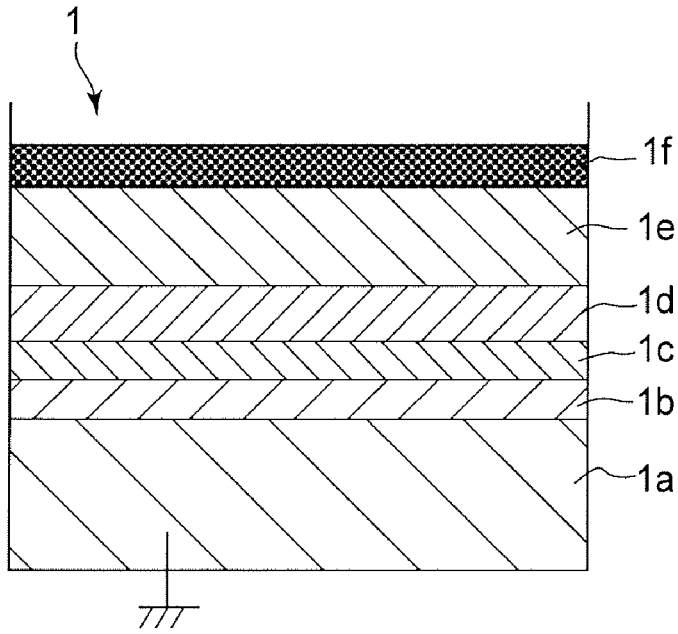
FIG. 3 is longitudinal sectional view illustrating a layer structure of a photosensitive drum.

In this embodiment, the photosensitive drum 1 is a negative charging OPC photosensitive member which is rotated in the direction indicated by the arrow R1 (clockwise) at a process speed (peripheral speed) of 150 mm/sec. As shown in FIG. 3, the photosensitive drum 1 comprises a drum base member 1*a* of aluminum having a direct diameter of 30 mm and comprises a first layer to a fifth layer in the order from the inside to the outside (from the bottom to the top in the Figure).

The first layer is a primer layer 1*b* which is an electroconductive layer having a thickness of approx. 20 m and which is effective to remove the defects in the drum base member 1*a*.

The second layer is a positive charge injection preventing layer 1*c* which is effective to prevent the positive charge injected from the drum base member 1*a* from canceling the negative charge on the surface of the photosensitive drum 1. The positive charge injection preventing layer 1*c* which is an intermediate resistance layer which has a thickness of approx. 1 μm and which has a resistance of approx. $10^6$ Ωcm provided by adjustment using AMILAN (tradename of polyamide resin material, available from Toray Kabushiki Kaisha, Japan) resin material and methoxymethyl Nylon.

The third layer is a charge generation layer 1*d*. The charge generation layer 1*d* comprises disazo pigment dispersed in resin material, has a thickness of approx. 0.3 μM, and is effective to generate a pair of positive and negative charges by being exposed to light.

The fourth layer is a charge transfer layer 1*e*. The charge transfer layer 1*e* is a P-type semiconductor comprising polycarbonate resin material and hydrazone dispersed therein. Therefore, the negative charge on the surface of the photosensitive drum 1 cannot move through the layer, and transports only the positive charge that is generated in the charge generation layer 1*d* to the surface of the photosensitive drum 1.

The fifth layer is a charge injection layer 1*f*. The charge injection layer 1*f* is a coating layer of material comprising a binder of insulative resin material and SnO2 particles dispersed therein. More particularly, the coating layer comprises insulative resin material in which 70 weight percent of SnO2 particles having a particle size of approx. 0.03 μm and doped with a light transmitting insulation filler which is antimony to reduce the resistance or to provide electroconductivity. Coating liquid of such a prescription is coated into a thickness of approx. 4 μm through a proper coating method such as a dip coating method, a spray coating method, a roll coating method, a beam coating method or the like. The opposite ends of the photosensitive drum 1 with respect to the axis thereof have photosensitive layer un-coating regions of 5 mm, respectively. An electrical resistivity of the charge injection layer if is $1\times10^{10}$-$1\times10^{14}$ Ω·cm with which a sufficient charging property and with which an image flow can be effectively prevented. In this embodiment, the photosensitive drum 1 has a resistivity of $1\times10^{11}$ Ωcm.

The magnetic brush charger 2 is effective to charge uniformly the surface of the photosensitive drum 1 to a predetermined potential of a predetermined polarity. A charging sleeve, which will be described hereinafter, of the magnetic brush charger 2 is supplied with a DC voltage of −700V as the charging bias voltage from a charging bias applying voltage source S1.

The magnetic brush charger 2 will be described hereinafter in detail.

The exposure device 3 as image information writing means is a laser beam scanner including a laser diode and a polygonal mirror (not shown) or the like. The exposure device 3 exposes the surface of the uniformly charged photosensitive drum 1 with a laser beam modulated in intensity corresponding to a time series electrical digital pixel signal indicative of image information (scanning exposure L). By this, the charge on the surface of the photosensitive drum 1 after the charging is removed only in the exposed portion so that electrostatic latent image is formed corresponding to the image information.

The electrostatic latent image is developed into a toner image by the developing device 4. The developing device 4 includes a rotary type developing device 4A and a developing device 4B independent therefrom. The rotary type developing device 4A includes a rotatable rotary 4*a* and three developing devices (for different colors) carried on the rotary 4*a*, namely, developing devices 4Y, 4M, 4C for yellow (Y), magenta (M) and cyan (C) developers, respectively. The developing devices 4Y, 4M, 4C are selectively placed at a developing position opposed to the photosensitive drum 1. On the other hand, the independent developing device 4B includes a developing device 4K which contains black (K) toner and which is movable toward and away from the photosensitive drum 1, and is placed close to the surface of the photosensitive drum 1 upon black toner development The intermediary transfer belt (intermediary transfer member) 5*a* as the toner image receiving member is stretched around a plurality of rollers in the image forming apparatus 100. The intermediary transfer belt 5*a* is held press-contacted to the photosensitive drum 1 with a predetermined urging force, and a primary transfer portion, namely, a primary transfer nip N1 with the photosensitive drum 1. The intermediary transfer belt 5*a* is rotated by driving means (not shown) in the direction of the arrow R1 at a peripheral speed which is slightly different from that of the photosensitive drum 1. In the primary transfer nip N1, the primary transfer roller 5*b* (primary transferring means) presses the intermediary transfer belt 5*a* to the photosensitive drum 1. The primary transfer roller 5*b* is supplied with a primary transfer bias having a polarity (positive in this embodiment) opposite the charge polarity of the toner on the photosensitive drum 1 from a primary transfer bias application voltage source (not shown). By this, the color toner images sequentially formed on the photosensitive drum 1 are overlaid (synthesization) by primary transfer sequentially onto the intermediary transfer belt 5*a*. The circumferential length of the intermediary transfer belt is longer than a length, measured in a feeding direction, of the recording material which can be fed by the image forming apparatus. The length of the intermediary transfer belt measured in the longitudinal direction is larger than the length of the primary transfer roller 5*b* measured in the longitudinal direction.

After the primary transfer of the toner image, the toner remaining on the surface of the photosensitive drum 1 is removed by a cleaning blade of a blade type drum cleaning device (cleaning member) 14 so as to be prepared for the next image formation.

Then, the recording materials 24 are fed one-by-one by a sheet feeding roller 10 from a sheet feeding cassette 9 and fed through a pair of registration rollers 11 and along a transfer guide 12 to the secondary transfer nip N2 (secondary transfer portion) at predetermined timing. At the timing, the secondary transfer roller 5*c* (secondary transferring means) contacts the transfer belt 7*a* to the intermediary transfer belt 5*a* in the secondary transfer nip N2. A transfer bias of the same polarity (negative in this embodiment) as the toner of the overlaid toner image of respective colors is supplied to the secondary transfer roller 5*c* from the secondary transfer bias application voltage source (not shown). By this, the toner image is secondary-transferred all together from the intermediary transfer belt 5*a* onto the surface of the recording material 24 (intermediary transfer belt 5*a* side surface) fed to the secondary transfer nip N2.

The recording material 24 now having the toner image transferred from the intermediary transfer belt 5*a* during passing through the secondary transfer nip N2 is fed to the fixing device 15 (fixing means). The recording material 24 is heated and pressed by a fixing device 15 including a fixing roller 16 and a pressing roller 17 controlled in the temperature and is subjected to fixing process, and is outputted to the outside of the image forming apparatus 100 as a print.

On the other hand, the toner (untransferred toner) remaining on the intermediary transfer belt 5*a* after the secondary transfer operation is removed by a belt cleaning device 18 of a blade type.

The operations and operation timing of various elements constituting the image forming apparatus 100, the levels of the applied voltage and so on are controlled by control means (not shown).

The cleaning device 14 comprises a cleaning blade (cleaning member) 14*a*, an auxiliary cleaning member 14*b*, a scraper 14*c* and a cleaner container. The cleaning device 14 further comprises a toner feeding screw (not shown) for collecting the untransferred toner or the like removed from the surface of the photosensitive drum 1 into a residual toner accommodating portion (not shown).

The cleaning blade 14*a* of this embodiment is made of urethane rubber having a thickness of 2 mm and is rectangular-like elongated along the axial direction of the photosensitive drum 1 (direction of the generating line). One of the long sides of the cleaning blade 14*a* is supported by the cleaner container 14*d*, and an edge of the other long side is counter-directionally contacted to the surface of the photosensitive drum 1. The cleaning blade 14*a* rubs the surface of the photosensitive drum 1 by the edge to remove foreign matter, such as the untransferred toner, talc, the charged carrier from the magnetic brush charger 2 which will be described hereinafter and so on from the surface of the photosensitive drum 1.

The auxiliary cleaning member 14*b* may be a fur brush, a resin material roller or magnet roller. In this embodiment, the magnet roller or fur brush is preferable since then the charged carrier remaining on the surface of the photosensitive drum 1 can be removed without damaging the surface. When the uses made with the magnet roller, it is not contacted to the surface of the photosensitive drum 1 but is disposed with a fine gap from the surface of the photosensitive drum 1. In this embodiment, the fur brush is used.

The fur brush 14*b* comprises a cylindrical rotatable member and a brush portion having a larger number of fur fibers planted on the outer surface of the rotatable member, the rotatable member is rotated while the brush portion is contacted to the surface of the photosensitive drum 1 to rub it. By this, the untransferred toner and so on the photosensitive drum 1 are scraped into the cleaner container 14*d* or deposited on the brush portion. The untransferred toner and so on deposited on the brush portion are beaten off the brush portion into the cleaner container 14*d*, by a scraper 14*c*. In this embodiment, the auxiliary cleaning member 14*b* is disposed such that phantom entering depth of the fibers into the surface of the photosensitive drum 1 is 0.7 mm, and is rotated in the clockwise direction at a peripheral speed ratio 125% relative to the peripheral speed of the photosensitive drum 1.

A description will be made as to the rotational direction and the peripheral speed ratio of the fur brush 14*b* which is suitable to accomplish the object of the present invention. In the case that peripheral moving directions of the photosensitive drum 1 and the fur brush 14*b* are opposite to each other at the position where they are contacted to each other, the peripheral speed ratio of the fur brush 14*b* may be any ratio because the charged carrier 2*c* can be collected without the charged carrier 2*c* sandwiched between the photosensitive drum 1 and the fur brush 14*b*. In the case that peripheral moving directions of the photosensitive drum 1 and the fur brush 14*b* are the same, at the position where they are contacted to each other, there is a possibility that charged carrier 2*c* is sandwiched between the photosensitive drum 1 and the fur brush 14*b*. Therefore, the peripheral speed of the fur brush 14*b* is preferably substantially equivalent to that of the photosensitive drum 1. This analysis as to the rotational direction and the peripheral speed ratio applies to the case where the auxiliary cleaning member is other than the fur brush 14*b*, for example, the magnet roller.

Figure 7:
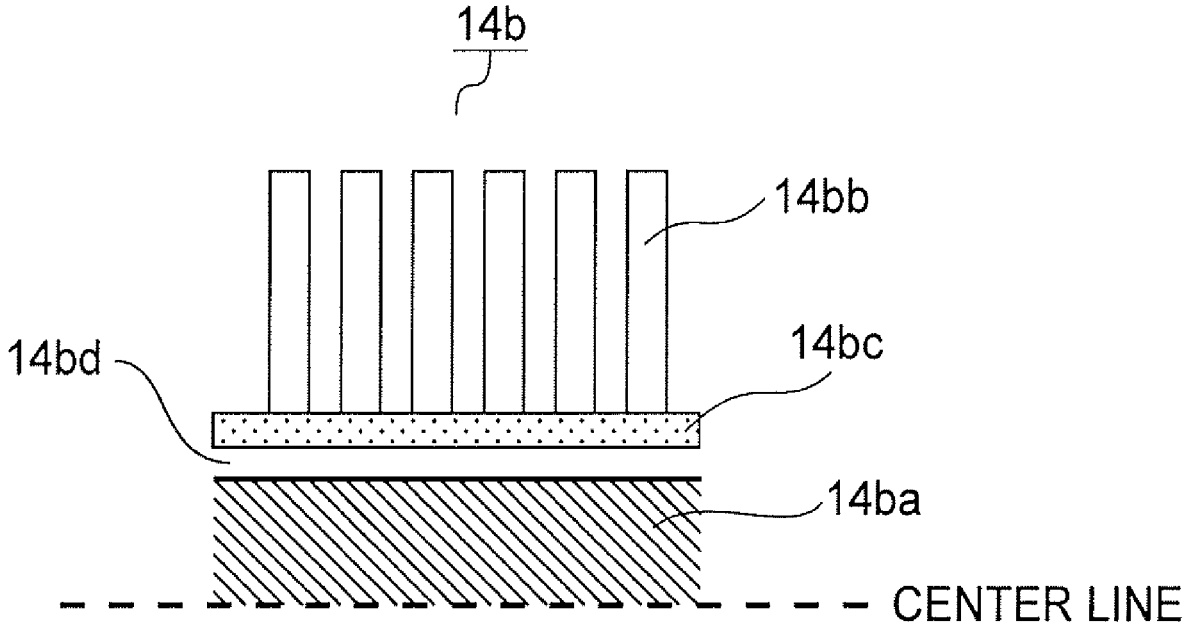
FIG. 7 is a cross-sectional view of a fur brush taken along a plane passing through a center thereof.

As shown in FIG. 7, the fur brush 14*b* comprises a rotation shaft 14*ba*, a cleaning brush fur member 14*bb*, a base textile 14*bc* in which the cleaning brush fur member 14*bb* is planted, and an adhesive material layer 14*bd* bonding the rotation shaft 14*ba* and the base textile 14*bc* or the like with each other. In this embodiment, the cleaning brush fur member 14*bb* is a straight fur and has a thickness of 6 D (denier) and a length of 5 mm arranged at the density of 50 kF. The material thereof may be an electroconductive material such as stainless steel or electroconductive rayon. In this embodiment, nylon is used.

By the provision of the cleaning device 14, the untransferred toner or the like can be collected from the surface of the photosensitive drum 1 assuredly. The charged carrier deposited at the end can be assuredly collected to accomplish high-quality images at high speed image formation with high stability. This will be described in detail.

Figure 4:
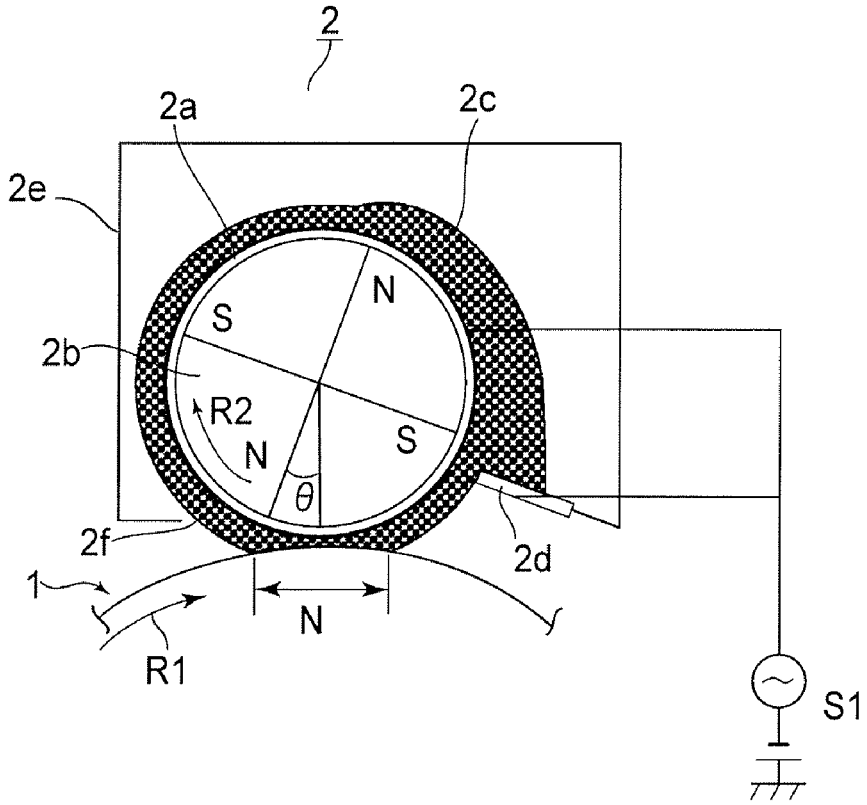
FIG. 4 is a longitudinal sectional view of a structure of a magnetic brush charger according to the embodiment of the present invention.

Referring to FIG. 4, the structure of the magnetic brush charger 2 will be described.

As shown in FIG. 4, the magnetic brush charger 2 comprises a charging sleeve (magnetic particle carrying member) 2*a*, a magnet roller 2*b*, a charged carrier (magnetic particles) 2*c*, a regulating blade 2*d* and a charged carrier accommodating container 2*e*. The charging sleeve 2*a* comprises a rotatable cylindrical member of non-magnetic material (stainless steel, for example). Inside the charging sleeve 2*a*, there is provided a magnet roller 2*b* which is not rotatable. The charged carrier 2*c* is confined magnetically by the magnet roller 2*b* on the surface of the charging sleeve 2*a* and is revolved by the rotation of the charging sleeve 2*a* in the same peripheral moving direction. The regulating blade 2*d* is made of non-magnetic material (stainless steel, for example) and functions to regulate a layer thickness of the charged carrier 2*c* carried on the surface of the charging sleeve 2*a*. The charged carrier 2*c* is accommodated in the charged carrier accommodating container 2*e*.

The charging sleeve 2*a* extends along the length of the charged carrier accommodating container 2*e* and is rotatably supported. The charging sleeve 2*a* is rotated at a peripheral speed of 150 mm/sec in the same rotational direction (arrow R2) as the photosensitive drum 1. Therefore, the surface of the charging sleeve 2*a* moves in the direction opposite the surface of the photosensitive drum 1 at the position where they are opposed to each other. The regulating blade 2*d* is disposed such that gap from the surface of the charging sleeve 2*a* is 900 μm. A part of the charged carrier 2*c* in the charged carrier accommodating container 2*e* is confined on the outer surface of the charging sleeve 2*a* by the magnetic force of the magnet roller 2*b*.

The magnetic brush 2*f* is rotated by the rotation of the charging sleeve 2*a* in the direction of arrow R2, that is, in the same direction as the charging sleeve 2*a*. During the rotation, the layer thickness of the magnetic brush 2*f* is regulated into a uniform thickness by the regulating blade 2*d*. The regulated layer thickness provided by the magnetic brush 2*f* is larger than the clearance between the charging sleeve 2*a* and the photosensitive drum 1 at the position where they are opposed to each other. By such an arrangement, the magnetic brush 2*f* contacts the photosensitive drum 1 to form a contact nip of a predetermined width therebetween. The contact nip is a charging nip N.

Thus, the photosensitive drum 1 is rubbed by the rotating magnetic brush 2*f* at the charging nip N with the rotation of the charging sleeve 2*a*. Here, in the charging nip N, the moving direction of the surface of the photosensitive drum 1 is opposite the moving direction of the magnetic brush 2*f*, so that relative moving speed therebetween is large. The charging sleeve 2*a* and the regulating blade 2*d* are supplied with a predetermined charging bias voltage from a charging bias applying voltage source S1. In this embodiment, the bias voltage is a voltage provided by superimposing a DC component and an AC component (superimposed bias) The photosensitive drum 1 and the charging sleeve 2*a* are rotated with the predetermined charging bias voltage being applied from the charging bias applying voltage source S1, by which the surface of the photosensitive drum 1 is contact-charged uniformly to a predetermined negative potential by injection charging.

The magnet roller 2*b* has a magnetic pole N (main pole) of 900 Gauss which is disposed at a position 10° upstream of the closest position where the charging sleeve 2*a* and the photosensitive drum 1 are closest with each other, with respect to the rotational direction. It is desirable that angle (fθ) of the position of the main pole from the closest position is within the range between 20° toward upstream and 10° toward downstream, more desirably, within the range of 15°-0° upstream from the closest position, with respect to the rotational direction of the photosensitive drum 1. If the position is more downstream with respect to the rotational direction of the photosensitive drum 1, the charged carrier 2*c* is attracted to the main pole position, and therefore, the charged carrier 2*c* tends to stagnate at the position downstream of the charging nip N. On the other hand, if it is more upstream, the feeding performance for the charged carrier 2*c* having passed through the charging nip N is poor with the tendency of stagnation. If there is no magnetic pole at the charging nip N, the confining force applied to the charged carrier 2*c* toward the charging sleeve 2*b* is weak, with the result of tendency for the charged carrier 2*c* to deposit on the photosensitive drum 1. A DC component of the charging bias voltage (DC bias plus AC bias) applied to the charging sleeve 2*a* by the charging bias applying voltage source is the same as the surface potential of the photosensitive drum 1, namely, −700V in this embodiment.

An AC component, during the image forming operation, preferably has a peak-to-peak voltage Vpp of not less than 100V and not more than 2000V, further preferably, not less than 300V and not more than 1200V. If the peak-to-peak voltage Vpp is less, the uniform charging property and the potential rising effect are poor with the result that stagnation of the charged carrier 2*c* and/or the deposition of the charged carrier 2*c* on the photosensitive drum 1 is significant. The frequency is preferably not less than 100 Hz and not more than 5000 Hz, more preferably, not less than 500 Hz and not more than 2000 Hz. If it is less, the deposition of the charged carrier 2*c* on the photosensitive drum 1 is significant, and the uniform charging property and the rising property of the potential are poor.

In this embodiment, the AC component of the charging bias voltage during the image forming operation has a rectangular waveform of 800V of peak-to-peak voltage Vpp and 1000 Hz of frequency. Further more, the waveform of the AC component is preferably a rectangular wave, triangular wave or sine wave.

The charged carrier 2*c* preferably has an average particle size of 10-100 μm, a saturation magnetization 20-250 emu/$cm^3$ and a resistance of $1\times10^2$-$1\times10^{10}$ Ωcm. In consideration of existence of insulation defects such as pin holes in the surface of the photosensitive drum 1, the resistance is preferably not less than $1\times10^6$ Ωcm. In order to improve the charging property, a small resistance is preferable, and therefore, the charged carrier 2*c* used in this embodiment has an average particle size of 25 μm, a saturation magnetization of 200 emu/$cm^3$ and a resistance of $5\times10^6$ Ωcm. The resistance value of the charged carrier 2*c* calculated from a current flowing when a voltage of 100V is applied to 2*g* of the charged carrier 2*c* which is placed in a metal cell having a bottom area of 228 $mm^2$ and which is pressed by approx. 64.7 N.

The charged carrier 2*c* may be a resin material carrier produced by dispersing magnetite (magnetic material) and dispersing carbon black for electroconductivity and for resistance adjustment, in resin material. The resistance adjustment may be effected by oxidation or deoxidization process of a surface of magnetite itself such as ferrite, or by coating a surface of magnetite itself such as ferrite with resin material.

A description will be made as to the end deposition of the charged carrier 2*c* and a counter-measurement against it, according to an embodiment of the present invention.

Figure 5:
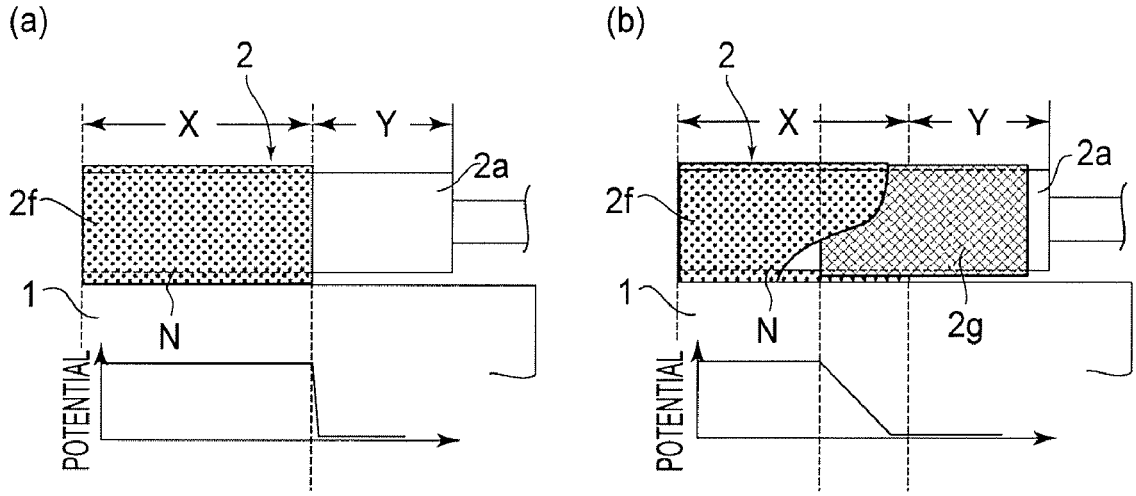
FIG. 5 illustrates end deposition of charged carrier particles in (a), and illustrates a structure for preventing the end deposition of the charged carrier in (b).

When no counter-measurement is taken against the problem of end deposition of the charged carrier 2*c*, a region X and a region Y appear, as shown in (a) of FIG. 5. The region X is a region where the charging sleeve 2*a* is coated with the charged carrier 2*c* in the magnetic brush charger 2. The region Y is a region which is longitudinally outside of the charging sleeve (closer to the end) and which is not coated with the charged carrier 2*c*. As shown at the bottom of (a) of FIG. 5, the photosensitive drum potential steeply changes at the boundary portion between the regions X and Y. The potential difference causes deposition of the charged carrier onto the surface of the photosensitive drum 1 from the magnetic brush charger 2 at the boundary portion between the regions X and Y.

According to this embodiment, even if the end deposition of the charged carrier 2*c* occurs on the photosensitive drum 1 by the magnetic brush charger 2, the developing device 4 and/or the transferring device 5 are not damaged. As a further improvement, the photosensitive drum 1 and/or the cleaning device 14 is protected from damage. The damage is prevented in the manner as shown in FIG. 1. The relations among the widths (the dimension measured in the widthwise direction with respect to the recording material feeding direction or longitudinal direction of the photosensitive drum) of the magnetic brush charger 2, the developing device 4, the transferring device 5 and the cleaning device 14 and so on are as shown in FIG. 1.

FIG. 1 shows end positions, with respect to the longitudinal directions, of the charging device, the exposure device, the development device, the transfer device, the cleaning device and the like. The figures in FIG. 1 are distances (mm) from the center of the image (the center of the image forming region).

The end b1 (161.5 mm) of the developer coated region of the developing sleeve 4*b* for supplying the developer is outside the end a1 (160.5 mm) of the exposure area (the end of the exposure device 3) for writing the image. In order to carry properly the developer, the end b2 (163 mm) of the magnet (magnet roller) in the developing sleeve is outside the end b1 the developer coated region of the developing sleeve 4*b*.

The region where the charged carrier 2*c* in the magnetic brush 2*f* of the magnetic brush charger 2 can deposit onto the photosensitive drum 1 at the end of the coated region of the charging sleeve 2*a* is the end c2 portion (172.65 mm) of the charged carrier coated region. According to the embodiment of the present invention, the end c2 of the charged carrier coated region is outside the end b2 of the magnet in the developing sleeve of the developing sleeve 4*b*, so that deposited charged carrier at the end portion of the photosensitive drum 1 is prevented from depositing onto the developing sleeve 4*b*, thus preventing the damage to the developing device 4.

The end d1 (163.5 mm) of the primary transfer roller 5*b*, of the transferring device 5, which is pressed against the photosensitive drum 1 inside the end c2 of the charged carrier coated region on the charging sleeve. By this, the end deposited carrier 2*c* on the surface of the photosensitive drum is prevented from damaging the photosensitive drum 1 and/or the transferring device 5 due to the deposited carrier 2*c* sandwiched in the transfer nip T. As to the end d2 (164.5 mm) of the intermediary transfer belt, as shown in the Figure, it will suffice if it is outside the end of the primary transfer roller 5*b* as is ordinary, since the deposited carrier 2*c* there does not damage the intermediary transfer belt and/or the photosensitive drum if only the end d1 of the transfer roller 5*b* is regulated. For the best advantages of the present invention, it is desirable that end d2 of the intermediary transfer belt is inside the end c2 of the charged carrier coated region of the charging sleeve. This is because the end deposited carrier 2*c* is not deposited on the intermediary transfer belt, and therefore, such deposited carrier 2*c* would not damage the intermediary transfer belt and/or the blade of the belt cleaning device 18. By this, the charged carrier 2*c* deposited on the photosensitive drum 1 can reach the cleaning device 14 without damaging the developing device 4, the transferring device 5 the photosensitive drum 1 and/or so on.

Here, ends of the devices, members and so on which are contact to or close to the photosensitive drum 1 are inside the end c2 of the charged carrier coated region of the charging sleeve 2*a* as will be apparent from the foregoing description.

In such a case, as described hereinbefore, the charged carrier 2*c* deposited on the photosensitive drum 1 at the end c2 of the charged carrier coated region of charged carrier coated region charging sleeve 2*a* may be sandwiched between the cleaning blade 14*a* of the cleaning device 14 and the photosensitive drum 1. This may cause the damage in the cleaning blade 14*a* as well as the photosensitive drum 1.

In order to prevent this, the end e1 (175 mm) of the fur brush is desirably outside the end c2 of the charged carrier coated region of the charging sleeve 2*a* and inside the cleaning blade end e2 (180 mm).

By this arrangement, most of the charged carrier 2*c* deposited on the end of the photosensitive drum 1 can be collected by the fur brush 14*b*, and a small amount of fine charged carrier particles 2*c* at the end portion can be scraped by the cleaning blade 14*a*. In this manner, such a charged carrier 2*c* on the photosensitive drum 1 can be collected assuredly without damaging the photosensitive drum 1 and/or the cleaning blade 14*a*.

Embodiment 2

In this embodiment, the magnetic brush charger 2 is prevented from depositing the charged carrier 2*c* on the end of the photosensitive drum 1. Similarly to (b) of FIG. 5, an insulative portion 2*g* for insulating electrically the charging sleeve 2*a* from the charged carrier 2*c* is provided on the surface of the charging sleeve adjacent to the end of the charged carrier coated region.

By the provision of the insulative portion 2*g*, the change of the surface potential on the photosensitive drum 1 from the region X to the region Y of charging sleeve 2*a* is made less steep, so that deposition of the charged carrier 2*c* can be suppressed. The region X is a region where the charging sleeve 2*a* is coated with the charged carrier 2*c* in the magnetic brush charger 2, and the region Y is a region which is longitudinally outside of the charging sleeve (closer to the end) and which is not coated with the charged carrier 2*c*.

However, as described above, even in such as case, it is possible that carrier deposition occurs when a lateral current decreases due to occurrence of a dielectric breakdown occurs in the insulative portion 2*g* or due to increase of the electric resistance of the charged carrier 2*c*.

According to this embodiment, even when the charged carrier 2*c* is deposited on the end of the photosensitive drum 1, the developing device 4 and/or the transferring device 5 are not damaged by the charged carrier 2*c*. In addition, the photosensitive drum 1 and/or the cleaning device 14 can be protected from damage. This is done by setting the width (with respect to the direction perpendicular to the sheet feeding direction) relations among the magnetic brush charger 2, the developing device 4, the transferring device 5 and the cleaning device 14, as shown in FIG. 6.

Figure 6:
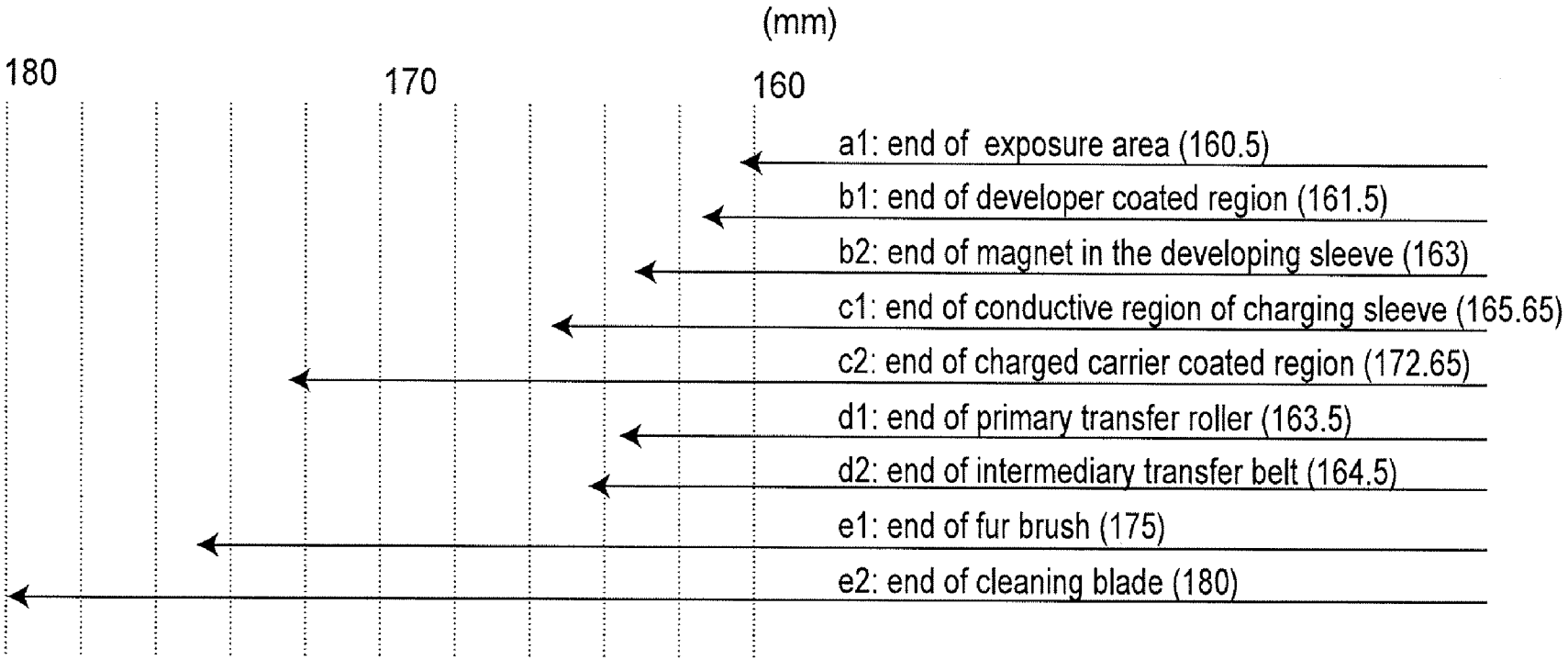
FIG. 6 is a diagram illustrating end positions of various parts of an electrophotographic image forming apparatus according to an embodiment of the present invention.

FIG. 6 shows the end positions of the charging device, the exposure device, the developing device, the transfer device, the cleaning apparatus and so on. The figures in FIG. 6 are distances (mm) from the center of the image (the center of the image forming region).

The end b1 (161.5 mm) of the developer coated region of the developing sleeve 4*a* for supplying the developer is outside the end a1 (160.5 mm) of the exposure area of the exposure device 3 for writing the image. In order to carry properly the developer, the end b2 (163 mm) of the magnet (magnet roller) in the developing sleeve is outside the end b1 the developer coated region of the developing sleeve 4*b*.

There is a region where the charged carrier 2*c* in the magnetic brush 2*f* of the magnetic brush charger 2 can deposit onto the photosensitive drum 1 at the end of the coated region of the charging sleeve 2*a*. This region from the end c1 (165.65 mm) of the electroconductive region of the charging sleeve 2*a* to the end c2 (172.65 mm) of the charged carrier coated region. The end c1 of the electroconductive region of the charging sleeve 2*a* and the end c2 of the charged carrier coated region are outside the end b2 of the magnet in the developing sleeve of the developing sleeve 4*a*. By this arrangement, the deposited charged carrier at the end of the photosensitive drum 1 is prevented from depositing onto the developing sleeve 4*a*, thus preventing the damage to the development.

Here, the end c2 of the charged carrier coated region is outside the end c1 of electroconductive region of the charging sleeve 2*a*.

The end d1 (163.5 mm) of the primary transfer roller 5*b* (the transfer charger 5*b*) of the transferring device 5 is inside the end c1 of the electroconductive region of the charging sleeve 2*a*. By this arrangement, the end deposited carrier 2*c* on the surface of the photosensitive drum is prevented from damaging the photosensitive drum 1 and/or the transferring device 5 due to the deposited carrier 2*c* sandwiched in the transfer nip T. As to the end d2 (164.5 mm) of the intermediary transfer belt, as shown in the Figure, it will suffice if it is outside the end of the primary transfer roller 5*b* as is ordinary, since the deposited carrier 2*c* there does not damage the intermediary transfer belt and/or the photosensitive drum if only the end d1 of the transfer roller 5*b* is regulated. For the best advantages of the present invention, it is desirable that end d2 of the intermediary transfer belt is inside the end c1 of the electroconductive region of the charging sleeve 2*a*. This is because the end deposited carrier 2*c* is not deposited on the intermediary transfer belt, and therefore, such deposited carrier 2*c* would not damage the blade of the belt cleaning device 18. By this, the charged carrier 2*c* deposited on the photosensitive drum 1 can reach the cleaning device 14 without damaging one or more of the developing device 4, the transferring device 5 the photosensitive drum 1, etc.

Here, ends of the devices, members and so on which are contact to or close to the photosensitive drum 1 are inside the end c1 of the electroconductive region of the charging sleeve 2*a* as will be apparent from the foregoing description.

In such a case, as described hereinbefore, the charged carrier 2*c* deposited on the photosensitive drum 1 at the end c2 of the charged carrier coated region of charged carrier coated region charging sleeve 2*a* may be sandwiched between the cleaning blade 14*a* of the cleaning device 14 and the photosensitive drum 1. This may damage the cleaning blade 14*a* as well as the photosensitive drum 1.

In order to prevent this, the end e1 (175 mm) of the fur brush is desirably outside the end c2 of the charged carrier coated region of the charging sleeve 2*a* and inside the end e2 of the cleaning blade.

By this arrangement, most of the charged carrier 2*c* deposited on the end of the photosensitive drum 1 can be collected by the fur brush 14*b*, and a small amount of fine charged carrier particles 2*c* at the end portion can be scraped by the cleaning blade 14*a*. In this manner, such a charged carrier 2*c* on the photosensitive drum 1 can be collected assuredly without damaging the photosensitive drum 1 and/or the cleaning blade 14*a*.

In this embodiment, the color image forming apparatus is of a one-drum type, but the present invention is applicable to a tandem type color image forming apparatus using a plurality of image bearing members with the same advantageous effects.

As described in the foregoing, even when the carrier is deposited on the image bearing member, the influence to the other members can be reduced, and when the carrier is collected from the image bearing member with the rotating operation, the collection defect of the carrier due to carrier scattering can be prevented.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 352754/2005 filed Dec. 6, 2005 which is hereby incorporated by reference.

What is claimed is:

1. An image forming apparatus comprising:

a rotatable photosensitive member;

charging means, including magnetic particles contacted to said photosensitive member and a magnetic particles carrying member for carrying said magnetic particles, for charging a surface of said photosensitive member;

developing means for developing an electrostatic image on said photosensitive member, said developing means including a toner carrying member for carrying toner, the toner carrying member having an end which is inside an end of a magnetic particles carrying region;

a transfer member for transferring a toner image from said photosensitive member onto a toner image receiving member;

a cleaning blade for removing the toner from said photosensitive member by contacting said photosensitive member at a contact position after a transfer operation of said transfer member, said cleaning blade having an end which is outside the end of the magnetic particles carrying region, wherein said charging means is disposed downstream of the contact position with respect to a rotational direction of said photosensitive member; and a cleaning brush, disposed upstream of the contact position with respect to the rotational direction of said photosensitive member, for removing the toner from said photosensitive member by contacting said photosensitive member, said cleaning brush having an end which is outside the end of the magnetic particles carrying region.

2. An apparatus according to claim 1, wherein said image receiving member is an intermediate transfer member, said intermediate transfer member having an end which is inside the end of the magnetic particles carrying region.

3. An apparatus according to claim 1, wherein the magnetic particles carrying region in a non-image region is insulative relative to the magnetic particles.

4. An apparatus according to claim 1, wherein said cleaning brush is a fur brush.

* * * * *